US008973601B2

(12) United States Patent
Puskas et al.

(10) Patent No.: US 8,973,601 B2
(45) Date of Patent: Mar. 10, 2015

(54) LIQUID CONDITION SENSING CIRCUIT AND METHOD

(75) Inventors: Peter J. Puskas, Freeport, IL (US); Steven H. Myers, Lena, IL (US)

(73) Assignee: Ultrasonic Power Corporation, Freeport, IL (US)

( * ) Notice: Subject to any disclaimer, the term of this patent is extended or adjusted under 35 U.S.C. 154(b) by 766 days.

(21) Appl. No.: 13/017,917

(22) Filed: Jan. 31, 2011

(65) Prior Publication Data

US 2011/0186155 A1 Aug. 4, 2011

Related U.S. Application Data

(60) Provisional application No. 61/300,211, filed on Feb. 1, 2010.

(51) Int. Cl.

| | |
|---|---|
| ***E03B 7/07*** | (2006.01) |
| ***B08B 3/12*** | (2006.01) |
| ***F17D 3/00*** | (2006.01) |

(52) U.S. Cl.

CPC .... *B08B 3/12* (2013.01); *F17D 3/00* (2013.01)
USPC ..... 137/238; 137/426; 137/391; 137/392; 137/393

(58) Field of Classification Search

CPC ..... F16K 21/18; F16K 1/446; F16K 31/22; E03D 1/31; B60K 15/04; B60K 15/035; G05D 9/12; B08B 9/032; B08B 9/0321; B01D 29/114
USPC ..... 137/238, 426, 392, 393, 391, 237; 73/1.73

See application file for complete search history.

(56) References Cited

U.S. PATENT DOCUMENTS

| | | | | | |
|---|---|---|---|---|---|
| 4,160,734 | A | * | 7/1979 | Taylor et al. | 210/96.1 |
| 4,244,749 | A | * | 1/1981 | Sachs et al. | 134/1 |
| 4,683,752 | A | * | 8/1987 | Bradshaw | 73/642 |
| 4,805,453 | A | * | 2/1989 | Haynes | 73/292 |
| 4,823,268 | A | * | 4/1989 | Giles et al. | 701/50 |
| 5,076,854 | A | * | 12/1991 | Honda et al. | 134/1 |
| 5,123,433 | A | * | 6/1992 | Fridsma et al. | 134/104.1 |
| 5,178,173 | A | * | 1/1993 | Erickson et al. | 134/184 |
| 5,322,082 | A | * | 6/1994 | Shibano | 134/186 |

(Continued)

FOREIGN PATENT DOCUMENTS

| | | | |
|---|---|---|---|
| EP | 0612570 | A2 | 8/1994 |
| JP | 2004-199714 | A | 7/1992 |

(Continued)

*Primary Examiner* — Peter Macchiarolo
*Assistant Examiner* — Mohammed Keramet-Amircola
(74) *Attorney, Agent, or Firm* — Reinhart Boerner Van Deuren P.C.

(57) ABSTRACT

A liquid condition sensor configured to monitor the condition of a liquid in an ultrasonic cleaning system tank, the liquid condition sensor including a first circuit configured to detect a signal transmitted from an ultrasonic generator to one or more ultrasonic transducers located in the tank. The liquid condition sensor further includes a second circuit coupled to the first circuit, the second circuit configured to determine if the signal is indicative of one of a suboptimal liquid level, and an unacceptably high concentration of dissolved gases in the cleaning liquid, and a third circuit coupled to the second circuit, the third circuit configured to provide a warning if one of a suboptimal liquid level, and an unacceptably high concentration of dissolved gases in the cleaning liquid is indicated by the second circuit.

20 Claims, 5 Drawing Sheets

(56) References Cited

U.S. PATENT DOCUMENTS

| | | | | |
|---|---|---|---|---|
| 5,452,611 | A * | 9/1995 | Jones et al. | 73/290 V |
| 5,706,840 | A | 1/1998 | Schneider et al. | |
| 5,739,724 | A * | 4/1998 | Alexandre et al. | 331/1 R |
| 5,810,037 | A * | 9/1998 | Sasaki et al. | 134/111 |
| 6,691,578 | B1 | 2/2004 | Puskas | |
| 7,562,570 | B2 * | 7/2009 | Peters | 73/290 V |
| 2003/0005942 | A1 * | 1/2003 | Johnson et al. | 134/1 |
| 2004/0003829 | A1 | 1/2004 | Hirae | |
| 2004/0232208 | A1 * | 11/2004 | Kondo | 228/110.1 |
| 2005/0284190 | A1 * | 12/2005 | Fan et al. | 68/3 SS |
| 2007/0236103 | A1 | 10/2007 | Tanzer et al. | |
| 2007/0261487 | A1 * | 11/2007 | Sintes et al. | 73/290 V |
| 2010/0037673 | A1 * | 2/2010 | Wicht et al. | 73/1.73 |

FOREIGN PATENT DOCUMENTS

| | | | | | |
|---|---|---|---|---|---|
| JP | 2009-094544 | A | | 4/1997 | |
| JP | 2010-057914 | A | | 3/1998 | |
| JP | 2001-029908 | A | | 2/2001 | |
| JP | 2002226829 | A | | 8/2002 | |
| JP | 2004-113846 | | * | 4/2004 | |
| JP | 2004-113846 | A | | 4/2004 | |
| JP | 2004113846 | A | * | 4/2004 | B08B 3/12 |
| JP | 2004-259983 | A | | 9/2004 | |
| JP | 2004259983 | A | * | 9/2004 | H01L 21/304 |
| JP | 2004-290940 | A | | 10/2004 | |
| WO | WO 87/02255 | A1 | | 4/1987 | |
| WO | WO 2004113846 | A1 | * | 12/2004 | G01D 9/00 |

* cited by examiner

LIQUID CONDITION SENSING CIRCUIT AND METHOD

CROSS-REFERENCE TO RELATED PATENT APPLICATIONS

This patent application claims the benefit of U.S. Provisional Patent Application No. 61/300,211, filed Feb. 1, 2010, the entire teachings and disclosure of which are incorporated herein by reference thereto.

FIELD OF THE INVENTION

This invention generally relates to ultrasonic cleaning systems, and, more particularly, to electronic systems used in the operation of ultrasonic cleaning systems.

BACKGROUND OF THE INVENTION

Ultrasonic energy is used in a variety of applications including, but not exclusive of, medical, industrial, and military applications. One common use for ultrasonic energy in manufacturing is for cleaning objects in liquids. In ultrasonic cleaning, a transducer, usually piezoelectric but sometimes magnetostrictive, is secured to or immersed in a cleaning tank to controllably impart ultrasonic vibration to the tank. The tank is filled with a cleaning liquid and parts are immersed into the liquid to be cleaned by ultrasonic agitation and cavitation. The ultrasonic energy itself can dislodge contaminants. Under certain conditions, the ultrasonic energy also creates cavitation bubbles within the liquid where the sound pressure exceeds the liquid vapor pressure. When the cavitation bubbles collapse, the interaction between the ultrasonically agitated liquid and the contaminants on the parts immersed in the liquid causes the contaminants to be dislodged.

In a typical ultrasonic cleaning system, the cleaning liquid is an aqueous solution, and parts immersed therein are cleaned via the aforementioned agitation and cavitation of the aqueous solution. Typically, the ultrasonic transducers transmit ultrasonic energy into the liquid-filled tank at frequencies of 18 kilohertz or greater, typically at a resonant frequency of the transducer and the load. The load includes the cleaning tank, the liquid in the tank, and the parts immersed in the liquid. When the ultrasonic transducer is driven at the resonant frequency of the load, the system is capable of delivering maximum power to the load.

The effectiveness of ultrasonic cleaning systems can be reduced by the presence of dissolved gases in the cleaning liquid. The presence of dissolved gases in the cleaning liquid used in ultrasonic cleaning systems may interfere with the cavitation that promotes the cleaning process. Typically, operators of ultrasonic cleaning systems will perform a degassing process for approximately ten minutes before commencing the actual cleaning. During this degassing process, the ultrasonic transducers are typically pulsed repeatedly for the entire ten minutes. Following the degassing process, the ultrasonic transducers can be switched to continuous operation needed for the cleaning operation.

Suboptimal liquid levels can also hinder the ultrasonic cleaning process. At certain liquid levels, the reflection of ultrasonic waves off of the surface of the liquid can create a destructive interference that reduces the energy effectively transferred from the ultrasonic transducers to the cleaning liquid. The ultrasonic energy which is transferred to the ultrasonic transducers, but which is not effectively transferred to the cleaning liquid is wasted. As a result, when suboptimal liquid levels are used, the cleaning times may need to be extended to achieve the same result that would be achieved in less time with optimal liquid levels. This increases cycle times and manufacturing costs for operators or ultrasonic cleaning systems.

It would therefore be desirable to have an ultrasonic cleaning system capable of providing the operator with an indication of the amount of dissolved gases in the cleaning liquid, and capable of indicating whether the cleaning liquid is at a suboptimal level. Embodiments of the invention provide such an ultrasonic cleaning system. These and other advantages of the invention, as well as additional inventive features, will be apparent from the description of the invention provided herein.

BRIEF SUMMARY OF THE INVENTION

In one aspect, embodiments of the invention provide a liquid condition sensor configured to monitor the condition of a liquid in an ultrasonic cleaning system tank, the liquid condition sensor including a first circuit configured to detect a signal transmitted from an ultrasonic generator to one or more ultrasonic transducers located in the tank. The liquid condition sensor further includes a second circuit coupled to the first circuit, the second circuit configured to determine if the signal is indicative of one of a suboptimal liquid level, and an unacceptably high concentration of dissolved gases in the cleaning liquid, and a third circuit coupled to the second circuit, the third circuit configured to provide a warning if one of a suboptimal liquid level, and an unacceptably high concentration of dissolved gases in the cleaning liquid is indicated by the second circuit.

In another aspect, embodiments of the invention provide a method of sensing the condition of liquid in an ultrasonic cleaning system tank, the method including detecting a signal being transmitted from an ultrasonic generator to an ultrasonic transducer, wherein the ultrasonic transducer is locating in a liquid-filled cleaning tank, and determining if the signal being transmitted is indicative of a suboptimal liquid level in the cleaning tank. The method of this embodiment further includes determining if the signal being transmitted is indicative of an unacceptably high concentration of dissolved gases in the cleaning liquid, providing a warning signal if it is determined that there is a suboptimal liquid level in the cleaning tank, and further providing a warning signal if it is determined that there is an unacceptably high concentration of dissolved gases in the cleaning liquid.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In an ultrasonic cleaning system having ultrasonic transducers coupled to a liquid-filled tank, several factors determine what portion of the energy from the ultrasonic transducers is actually directed toward cleaning, versus that portion of the energy which is wasted. One of these factors is the level of cleaning liquid in the tank. Another factor is the amount, or concentration, of gases dissolved in the cleaning liquid. In an embodiment of the invention, a liquid condition sensing circuit is coupled to the output transformer of an ultrasonic power generator. The liquid condition sensing circuit is configured to indicate whether an unacceptably high portion of the power from the ultrasonic transducer is being wasted. In so doing, it becomes possible to reduce the amount of wasted energy by adjusting two of the above-named factors to increase the overall efficiency of the cleaning process.

Figure 1:
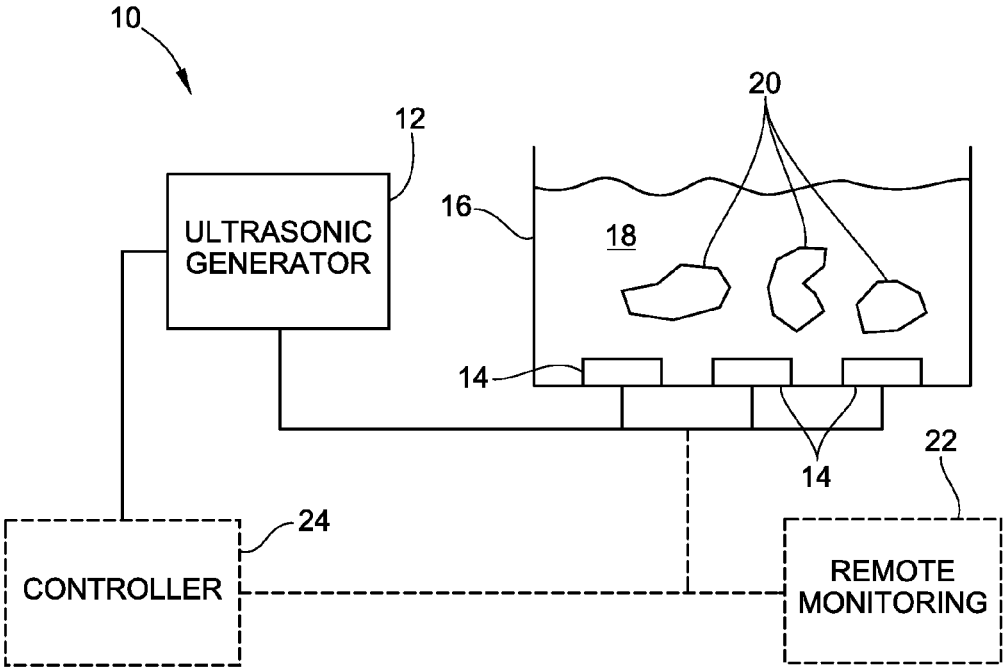
FIG. 1 is a schematic illustration of an exemplary ultrasonic cleaning system incorporating an embodiment of the invention.

FIG. 1 is a schematic illustration of an exemplary ultrasonic cleaning system 10 incorporating an embodiment of the invention. The ultrasonic cleaning system 10 includes an ultrasonic generator 12, which in one embodiment, supplies AC electrical power to a plurality of ultrasonic transducers 14 which are positioned in a cleaning tank 16. Alternate embodiments of the invention include ultrasonic cleaning systems having a greater number or lesser number of ultrasonic transducers 14 than the three shown in FIG. 1. While the ultrasonic transducers 14 are shown as being positioned at the bottom of cleaning tank 16, the ultrasonic transducers 14 could be mounted on the sides, bottom, or positioned at some other location within the cleaning tank 16. An aqueous or semi-aqueous cleaning liquid 18 fills the cleaning tank 16 enough to sufficiently cover a plurality of parts 20 being cleaned. In another embodiment of the invention, the cleaning system 10 includes a connection (shown in phantom) from the circuitry driving the ultrasonic transducers 14 to a remote monitoring station 22 (shown in phantom). A controller 24 (shown in phantom) is also connected to the circuitry driving the ultrasonic transducers 14, and is connected to the ultrasonic generator 12.

In operation, power supplied to the ultrasonic transducers 14 by the electrical ultrasonic generator 12 causes the ultrasonic transducers to transmit acoustical energy into the cleaning liquid 18 thereby producing the agitation and cavitation in the cleaning liquid 18 that cleans the plurality of parts 20. In at least one embodiment, the ultrasonic cleaning system includes a warning system configured to transmit a signal to the remote monitoring station 22, such that one operator may monitor a number of such cleaning systems from a single location. Embodiments of the invention allow for such warnings to be transmitted in the event that the condition of the cleaning liquid is suboptimal for ultrasonic cleaning. For example, it is contemplated that the warning system may be coupled to a controller 24, which upon receipt of a signal indicating that the cleaning liquid has an unacceptably high concentration of dissolved gases, may execute, for example, a degassing procedure. In the event that a warning is transmitted due to the cleaning liquid being at a suboptimal liquid level, the controller 24 may also be configured to terminate all power from the ultrasonic generator 12 to the ultrasonic transducers 14 until the liquid level is adjusted.

Figure 2:
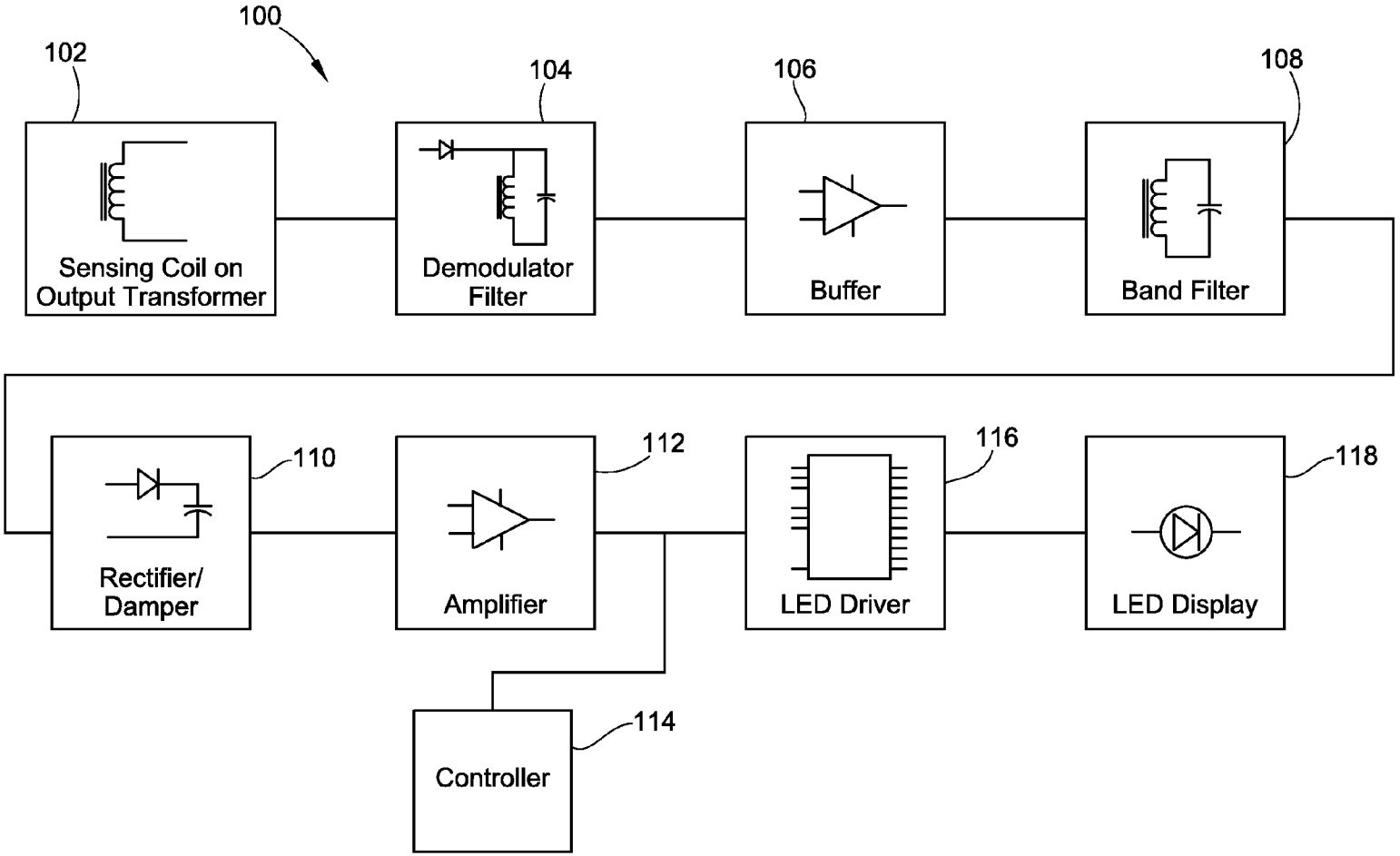
FIG. 2 is a block diagram for a liquid condition sensing circuit according to an embodiment of the invention.

FIG. 2 is a block diagram illustrating an exemplary liquid condition sensing circuit 100, according to an embodiment of the invention. The block diagram of FIG. 2 shows that this embodiment of the liquid condition sensing circuit 100 includes a first circuit having a sensing coil 102 or generator output current pick-up (current transformer) on the output transformer of the ultrasonic generator. The sensing coil 102 is coupled to a second circuit which includes a demodulator filter 104, buffer 106, band-pass filter 108, rectifier 110 and amplifer 112. The demodulator filter 104 has an output which is fed into a buffer 106. The buffer 106 is coupled to the band-pass filter 108, whose output is coupled to the input of the rectifier 110. The output of the rectifier 110 is amplified by amplifier 112. The amplifier 112 output is routed to a third circuit that includes at least a portion of controller 114 and an LED driver 116, which drives an LED display 118.

The controller 114 is configured in one embodiment to implement a degassing process if the amplifier 112 signal indicated the need for degassing. Typically, degassing involves pulsing the ultrasonic transducer 14 (in FIG. 1) repeatedly at regular intervals, for example on for 10 seconds then off for 10 seconds, for up to ten minutes to purge the dissolved gases from the cleaning liquid 18 (in FIG. 1). Upon detection of high concentrations of dissolved gases in the cleaning liquid 18 as will be discussed below, the controller 114 is configured to automatically commence a degassing procedure that may last several minutes. The liquid condition sensing circuit 100, either periodically or continuously, senses the condition (i.e., dissolved gas concentration) of the cleaning liquid 18 to determine if further or continuing degassing is required. This procedure is repeated until the liquid condition sensing circuit 100 determines an acceptable level of dissolved gases in the cleaning fluid 18.

The controller 114 is configured to implement other control functions in addition to the degassing process in other embodiments. For example, in one embodiment the controller 114 is configured to shut off power to the transducers 14 (in FIG. 1) if a suboptimal liquid level is indicated. In another embodiment of the invention, the controller 114 is configured to automatically adjust the level of cleaning liquid 18 (in FIG. 1) in the tank 16. The liquid condition sensing circuit 100 could then sense the level of the cleaning liquid 18 to determine if additional adjustment of the liquid level is required. The LED driver 116 is coupled to an LED display 118 and is configured to indicate to an operator when the liquid condition is or is not optimal for ultrasonic cleaning. However, in other embodiments of the invention, an audio warning system is employed in addition to, or instead of, a visual warning system, to alert operators when the liquid condition is or is not optimal for ultrasonic cleaning.

Figure 3:
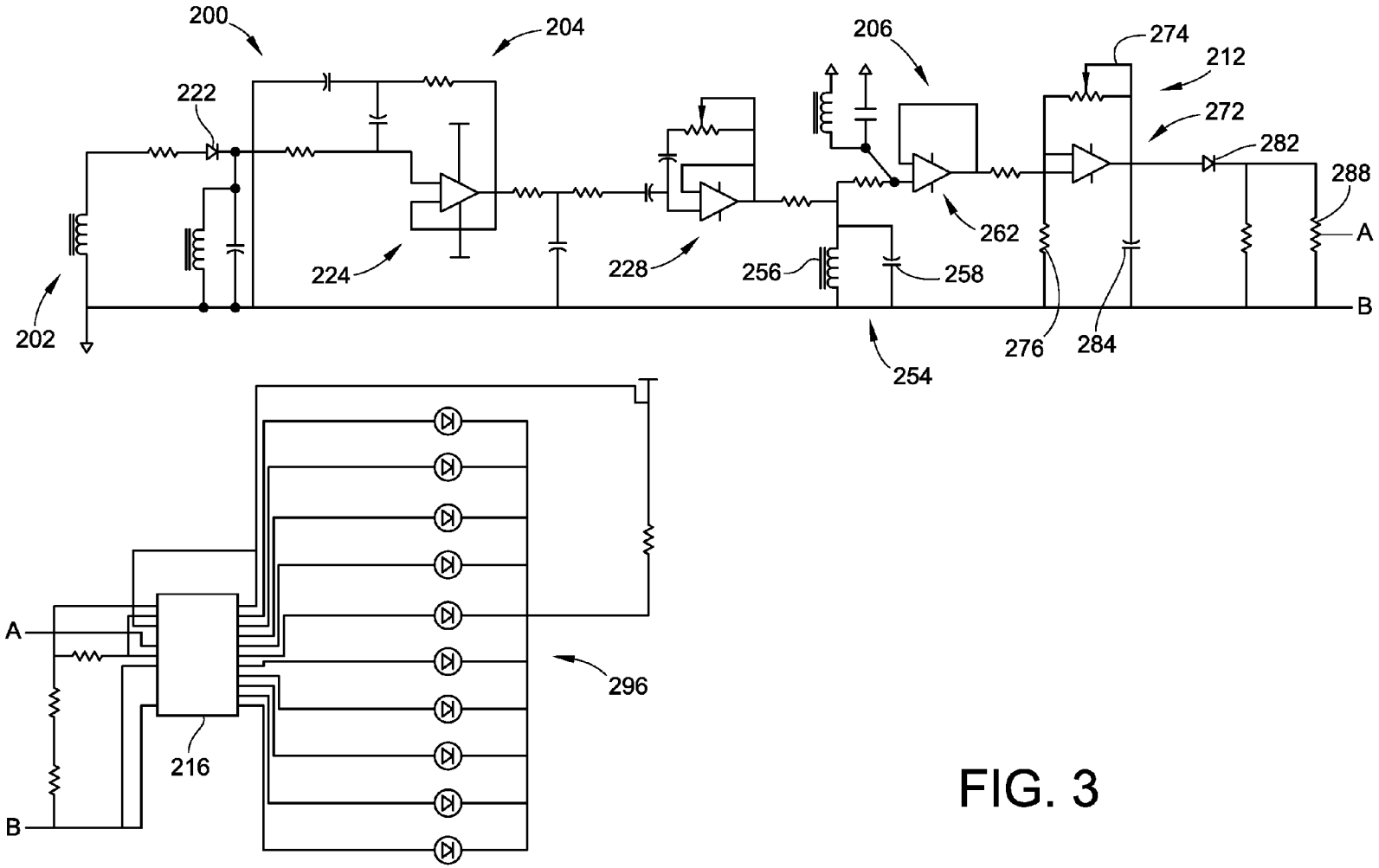
FIG. 3 is a schematic circuit diagram of a liquid condition sensing circuit, according to an alternate embodiment of the invention.

FIG. 3 is a schematic circuit diagram of an exemplary liquid condition sensing circuit 200, according to an alternate embodiment of the invention. The circuit diagram of FIG. 3 shows that the sensing coil 202. The demodulation filter 204 includes a diode 222. The diode 222 provides half-wave rectification of the AC signal from the sensing coil 202. The diode 222 is coupled to a first active filter having a first op-amp circuit 224 configured to filter out signals of a given frequency. In at least one embodiment, the first active filter is configured to filter out signals at approximately 120 hertz. The first active filter is coupled to a second active filter having a second op-amp circuit 228 configured as a band-pass filter. In at least one embodiment, the second active filter is configured to pass signals at approximately three kilohertz. The second active [band-pass] filter is coupled to a first passive band-pass filter 254.

The first passive band-pass filter 254 includes an inductor 256 and a capacitor 258. In an embodiment of the invention, the band-pass filter 254 is configured to pass signals in the 38 kHz to 42 kHz range. The filtered signal is coupled to an input of a buffer 206. Buffer 206 includes a third op-amp circuit 262 where the op-amp is configured for unity gain. The buffer 206 provides isolation of the electrical impedance at the buffer's output from the impedance at the buffer's input. The output of the buffer 206 is coupled to an input of an amplifier 212. The amplifier 212 includes a fourth op-amp circuit 272, which is configured such that the gain of the amplifier 212 is determined by a first variable resistor 274 and a resistor 276. Using first variable resistor 274 allows the gain of the amplifier 212 to be adjusted as necessary. In an embodiment of the invention, the first variable resistor 274 can be adjusted to a value up to 100 kilohms, while the resistor 276 has a value of approximately one kilohm, giving the amplifier 212 a maximum gain of approximately 100. In operation, the resistance value of the variable resistor 276 is chosen such that the amplifier gain must be sufficient to supply the LED driver 216 with enough voltage to operate a bank of LEDs 296.

The output of the amplifier 212 is coupled to a second passive band-pass filter. This second passive band-pass filter includes a capacitor 284. In at least one embodiment of the invention, the second passive band-pass filter is configured to pass signals at approximately three kilohertz. The filtered signal from the second passive band-pass filter is input to a second diode 282, which ensures the voltage to the LED driver 216 is positive, and to a second variable resistor 288. The voltage across the second variable resistor 288 is used to drive the LED driver 216, which powers an LED display 218 that includes the bank of LEDs 296, which serve to warn the operator of suboptimal conditions in the cleaning liquid 18 (in FIG. 1).

Figure 4:
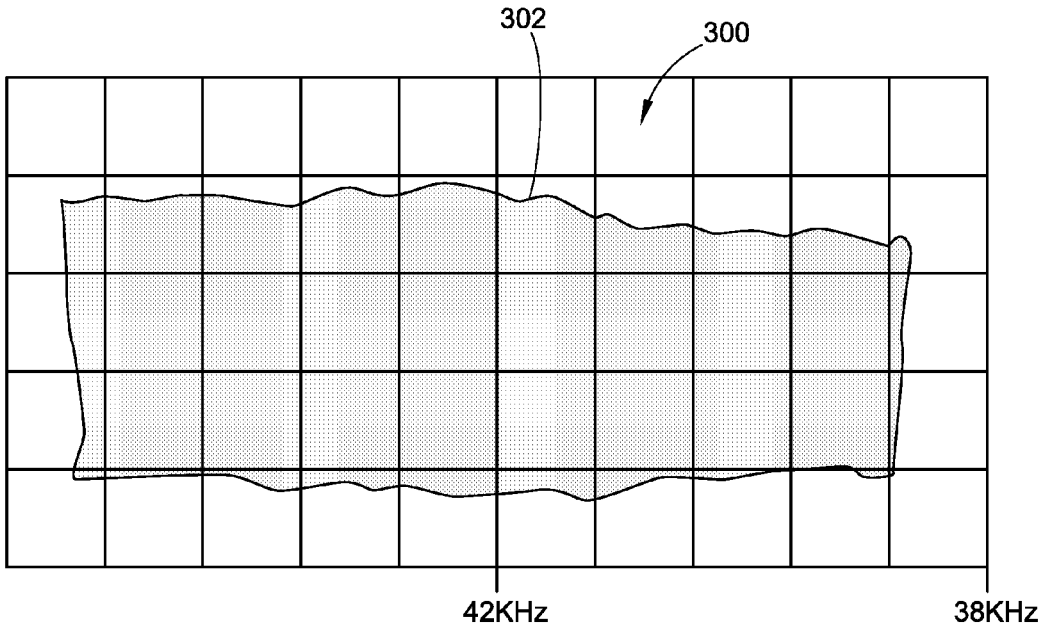
FIG. 4 is a graphical representation of an exemplary waveform for liquid in an ultrasonic cleaning tank at a suboptimal level or having suboptimal gas concentration.

FIG. 4 is a graphical representation of an exemplary waveform 300 sensed by the liquid condition sensing circuit 200 (in FIG. 3) for cleaning liquid 18 in an ultrasonic cleaning tank 16 (in FIG. 1), when the liquid 18 is at a suboptimal liquid level or has an unacceptably high concentration of dissolved gases. The graphical representation of FIG. 4 shows an exemplary first waveform 300 of the type that would be displayed by a spectrum analyzer attached to the output transformer (not shown) of an ultrasonic generator 12 (in FIG. 1). The first waveform 300 of FIG. 4 shows the signal from the output transformer of the ultrasonic generator in the frequency range of 38 kHz to 42 kHz.

As can be seen in FIG. 4, the first waveform 300, which indicates a high concentration of dissolved gases in the cleaning liquid 18 (in FIG. 1), is characterized by near-constant or very gradually changing peak amplitudes 302. The near-constant peak amplitudes 302 shown here are characteristic of an absence of the cavitation normally present in the ultrasonic cleaning process. While the first waveform 300 shows that there is little or no cavitation in cleaning liquid 18, the liquid itself may show evidence of disturbance at the surface. It is also typically the case that the output transformer of the ultrasonic generator 12 will generate a signal like that shown in first waveform 300 when the cleaning liquid 18 has a low concentration of dissolved gases, but is at a suboptimal liquid level. At certain liquid levels, ultrasonic waves in the cleaning liquid 18 reflect off of the surface and destructively interfere with other ultrasonic waves in the liquid. As a result, only a fraction of the ultrasonic energy transmitted by the transducers 14 (in FIG. 1) is available to produce the cavitation in the cleaning liquid 18 that promotes the cleaning process.

Figure 5:
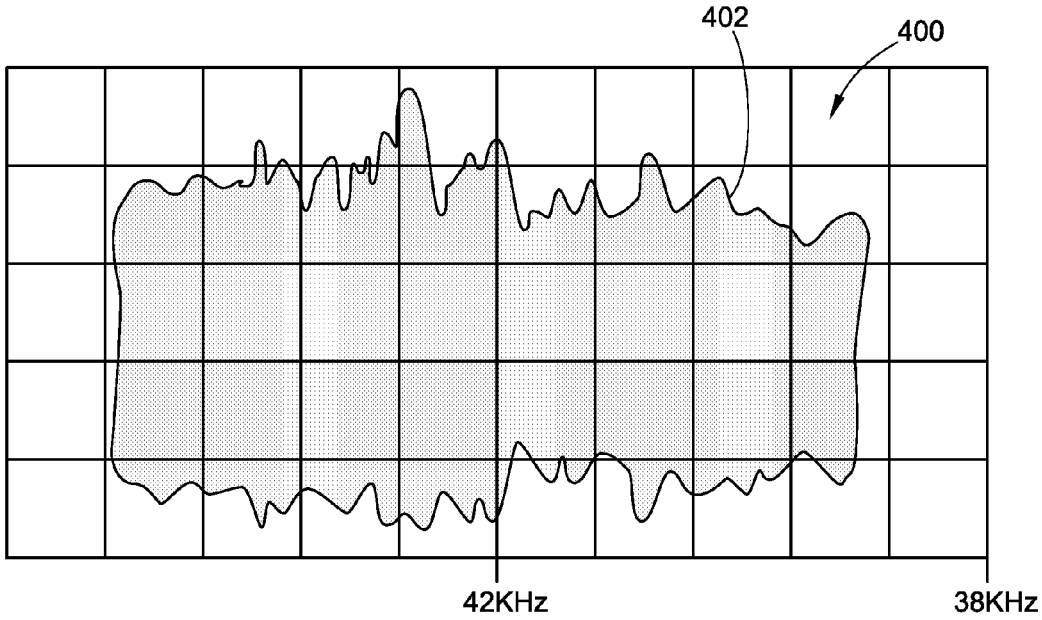
FIG. 5 is a graphical representation of an exemplary waveform for liquid having optimal gas concentration or for liquid at an optimal level in the cleaning tank.

FIG. 5 is a graphical representation of an exemplary second waveform 400 sensed by the liquid condition sensing circuit 200 (in FIG. 3) for cleaning liquid 18 in an ultrasonic cleaning tank 16 (in FIG. 1), when the liquid 18 at an optimal liquid level or has an acceptably low concentration of dissolved gases. The graphical representation of FIG. 5 shows the second waveform 400 of the type that would be displayed by a spectrum analyzer attached to the output transformer (not shown) of an ultrasonic generator 12 (in FIG. 1). The second waveform 400 of FIG. 5 shows the signal from the output transformer of the ultrasonic generator 12 in the frequency range of 38 kHz to 42 kHz.

As can be seen in FIG. 5, the second waveform 400, which indicates an acceptably low concentration of dissolved gases in the cleaning liquid (in FIG. 1), is characterized by abrupt, seemingly random, changes in the peak amplitudes 402. The abruptly-changing peak amplitudes 402 shown here are characteristic of the presence of cavitation in the cleaning liquid 18, cavitation that is normally present in the ultrasonic cleaning process. In an embodiment of the invention, the peak amplitudes 402 have an average frequency of approximately three kilohertz. As a result, a liquid condition sensing circuit employing band pass filters configured to pass signals of approximately three kilohertz, would pass through these peak amplitudes 402.

Those signals passing through the band-pass filters would drive, or light some number of the bank of LEDs 296, thus indicating good cavitation in the cleaning liquid 18. Depending on the magnitude of the peak amplitudes 302, and on the resistance values chosen for the first and second variable resistors 274, 288, the second waveform 400 could light one or all of the bank of LEDs 296. While the waveform 400 shows that there is sufficient cavitation in the cleaning liquid 18, the liquid itself may show little or no signs of disturbance at the surface.

In the first waveform 300 of FIG. 4, the lack of peak amplitudes like those in second waveform 400 means that there would be essentially no signal passing through the band-pass filters, and thus no signal to drive any of the bank of LEDs 296. As such, none of the bank of LEDs 296 would light in the case of the first waveform 300. In an embodiment of the invention, the first waveform 300 could trigger the controller 114 (in FIG. 1) to automatically start a degassing procedure, in which the ultrasonic transducers are pulsed repeatedly until the waveform resembles the second waveform 400. When the cleaning liquid 18 has been degassed, a waveform resembling the first waveform 300 could also alert the operator that the liquid level is suboptimal. In at least one embodiment of the invention, the controller 114 is configured to automatically adjust the water level until the waveform resembles the second waveform 400.

In an alternate embodiment, the controller 114 (in FIG. 1) is configured to automatically sense the level of parts loading in the cleaning tank 16, and to adjust the power level accordingly. For example, when parts are removed from a fully loaded cleaning tank 16, the peak amplitudes of the waveform sensed by the liquid condition sensing circuit 200 (in FIG. 3) will become more random with more abrupt changes. If the part loading in the tank 16 is reduced such that the waveform shows more abruptly changing peak amplitudes than shown in the second waveform 400, the controller 114 may determine, based on the waveform, that the power being supplied to the ultrasonic transducers 14 can be reduced without adversely affecting the cleaning process, thus saving energy.

Conversely, if parts are added increasing the load in the cleaning tank 16, the peak amplitudes of the waveform sensed by the liquid condition sensing circuit 200 (in FIG. 3) will become smoother and less random. When loading in the tank 16 increases to the point that the waveform resembles first waveform 300 (in FIG. 4), the controller may determine, based on the waveform, that power to the ultrasonic transducers 14 needs to be increased to properly clean the parts in the tank 16. Additionally, cycle time may be reduced by eliminating the need for the operator to adjust the power supplied to the ultrasonic transducers 14.

In this manner, the controller 114 automatically adjusts the power to the ultrasonic transducers 14 based on a determination of the level of parts loading in the cleaning tank 16, based on the peak amplitudes in the waveform sensed by the liquid condition sensing circuit 200 (in FIG. 3), to increase efficiency and reduce cycle times. In an embodiment of the invention, the automatic power level adjustment is performed after completion of the above-mention degassing procedure and the optimal liquid level determination.

Figure 6:
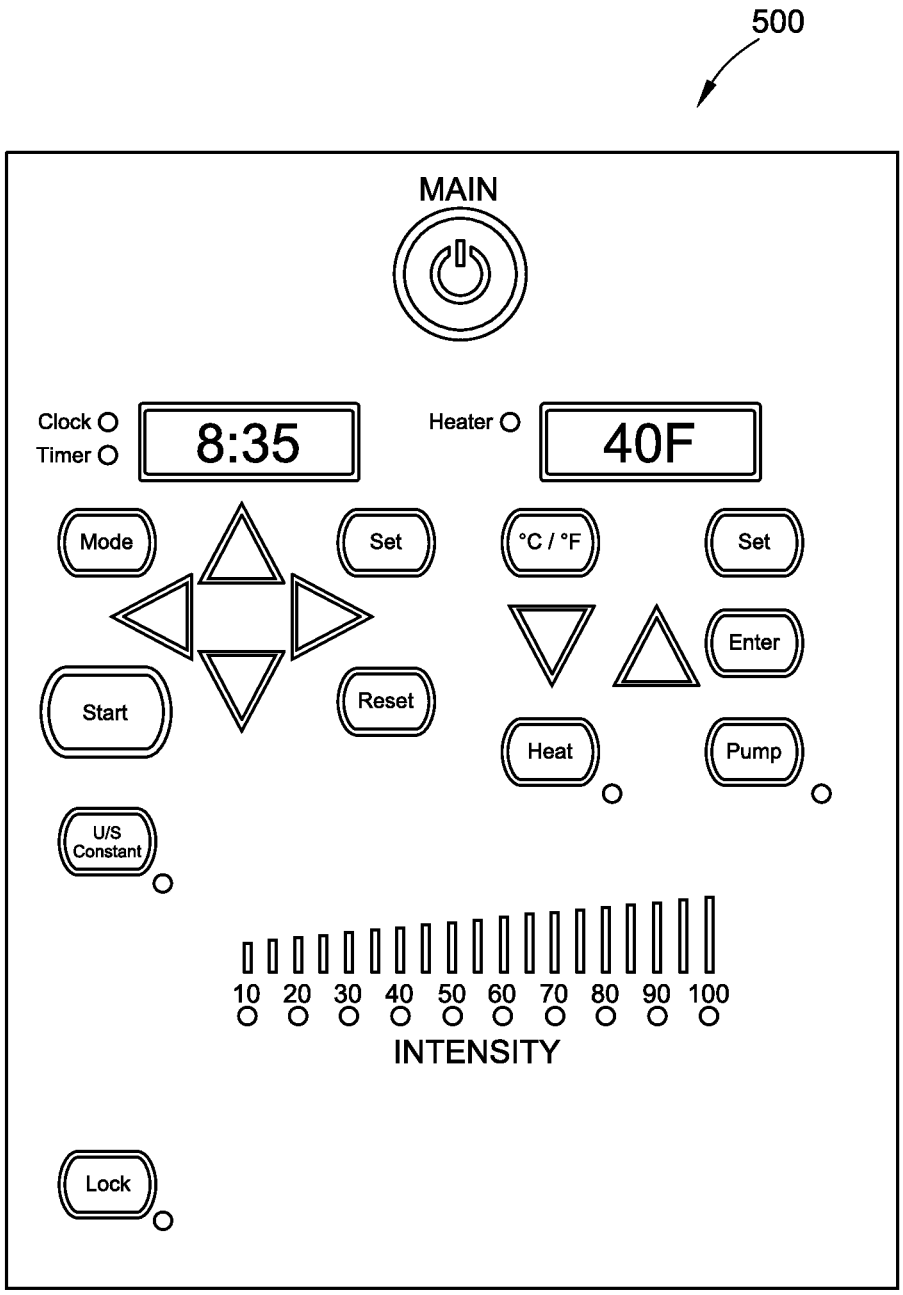
FIG. 6 is a plan view of an exemplary control panel which may be used with embodiments of the invention.

FIG. 6 is a plan view of an exemplary control panel 500 which may be used with embodiments of the invention. The control panel 500 includes a power button, and displays for a clock, timer and thermometer, along with control buttons to adjust time, the timer, and temperature. The control panel 500 further includes and intensity bar that includes the bank of LEDs 296 which alert the operator to the condition of the cleaning liquid 18 in the tank 16.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A liquid condition sensor configured to monitor cavitation activity of a liquid in an ultrasonic cleaning system tank, the liquid condition sensor comprising:

a first circuit configured to detect a signal transmitted from an ultrasonic generator to one or more ultrasonic transducers located in the tank;

a second circuit coupled to the first circuit, the second circuit configured to determine if the signal is indicative of one of a suboptimal liquid level, and an unacceptably high concentration of dissolved gases in the cleaning liquid, each of which results in less than optimal cavitation activity;

a third circuit coupled to the second circuit, the third circuit configured to provide a warning if one of a suboptimal liquid level, and an unacceptably high concentration of dissolved gases in the cleaning liquid is indicated by the second circuit.

2. The liquid condition sensor of claim 1, wherein the first circuit comprises a sensing coil coupled to an output transformer of the ultrasonic generator.

3. The liquid condition sensor of claim 2, wherein the sensing coil is inductively coupled to the output transformer of the ultrasonic generator.

4. The liquid condition sensor of claim 1, wherein the second circuit comprises a demodulator and filtering circuit configured to convert an AC signal output from the first circuit into a pulsed DC signal.

5. The liquid condition sensor of claim 4, wherein the second circuit further comprises a band-pass filter and an amplifier.

6. The liquid condition sensor of claim 5, wherein the band-pass filter is configured to pass a portion of the signal between approximately 38 kHz and 42 kHz.

7. The liquid condition sensor of claim 5, further comprising a buffer circuit coupled between the band-pass filter and the amplifier.

8. The liquid condition sensor of claim 1, wherein the third circuit is comprises a rectifier and an LED driver coupled to a plurality of LEDs.

9. The liquid condition sensor of claim 1, further comprising a controller configured to execute a control function when the signal is indicative of one of a suboptimal liquid level, and an unacceptably high concentration of dissolved gases in the cleaning liquid.

10. The liquid condition sensor of claim 9, wherein the control function comprises a degassing procedure.

11. The liquid condition sensor of claim 9, wherein the control function comprises shutting off power to one or more ultrasonic transducers due to an indication of suboptimal liquid level.

12. The liquid condition sensor of claim 9, wherein the control function comprises adjusting a level of the liquid level in the tank.

13. A method of sensing cavitation activity of liquid in an ultrasonic cleaning system tank, the method comprising:

detecting a signal being transmitted from an ultrasonic generator to an ultrasonic transducer, wherein the ultrasonic transducer is located in a liquid-filled cleaning tank;

determining if the signal being transmitted is indicative of a suboptimal liquid level and less than optimal cavitation activity in the cleaning tank;

determining if the signal being transmitted is indicative of an unacceptably high concentration of dissolved gases and less than optimal cavitation activity in the cleaning liquid;

providing a warning signal if it is determined that there is a suboptimal liquid level and less than optimal cavitation activity in the cleaning tank; and providing a warning signal if it is determined that there is an unacceptably high concentration of dissolved gases and less than optimal cavitation activity in the cleaning liquid.

14. The method of claim 13, wherein detecting a signal being transmitted from an ultrasonic generator to an ultrasonic transducer comprises detecting a signal using a sensing coil coupled to an output transformer of the ultrasonic generator.

15. The method of claim 13, wherein determining if the signal being transmitted is indicative of a suboptimal liquid level and less than optimal cavitation activity in the cleaning tank comprises demodulating and filtering the signal being transmitted to convert the signal from an AC signal into a pulsed DC signal.

16. The method of claim 15, wherein determining if the signal being transmitted is indicative of a suboptimal liquid level and less than optimal cavitation activity in the cleaning tank further comprises filtering the signal to pass a portion of the signal between approximately 38 kHz and 42 kHz, and amplifying the filtered signal.

17. The method of claim 13, wherein determining if the signal being transmitted is indicative of an unacceptably high concentration of dissolved gases and less than optimal cavitation activity in the cleaning liquid comprises demodulating and filtering the signal being transmitted to convert the signal from an AC signal into a pulsed DC signal.

18. The method of claim 17, wherein determining if the signal being transmitted is indicative of an unacceptably high concentration of dissolved gases and less than optimal cavitation activity in the cleaning liquid further comprises filtering the signal to pass a portion of the signal between approximately 38 kHz and 42 kHz, and amplifying the filtered signal.

19. The method of claim 13, further comprising commencing a degassing procedure if it is determined that there is an unacceptably high concentration of dissolved gases and less than optimal cavitation activity in the cleaning liquid.

20. A liquid condition sensor configured to monitor cavitation activity of a liquid in an ultrasonic cleaning system tank, the liquid condition sensor comprising:

a first circuit configured to detect a signal transmitted from an ultrasonic generator to one or more ultrasonic transducers located in the tank;

a second circuit coupled to the first circuit, the second circuit configured to determine if the signal is indicative of an unacceptably high concentration of dissolved gases and less than optimal cavitation activity in the cleaning liquid;

a third circuit coupled to the second circuit, the third circuit configured to provide a warning if an unacceptably high concentration of dissolved gases in the cleaning liquid is indicated by the second circuit.

* * * * *